US006508717B2

(12) United States Patent
Katayama

(10) Patent No.: US 6,508,717 B2
(45) Date of Patent: Jan. 21, 2003

(54) SKIING FACILITIES CAPABLE OF CHANGING SHAPE OF SURFACE OF SKI SLOPE AND METHOD FOR CHANGING SHAPE OF SURFACE OF SKI SLOPE OF SKIING FACILITIES

(75) Inventor: Minoru Katayama, Hiroshima (JP)

(73) Assignee: Kabushiki Kaisha Piste Snow Industries, Tokyo (JP)

( * ) Notice: Subject to any disclaimer, the term of this patent is extended or adjusted under 35 U.S.C. 154(b) by 0 days.

(21) Appl. No.: 09/847,029

(22) Filed: May 1, 2001

(65) Prior Publication Data

US 2002/0165034 A1 Nov. 7, 2002

(51) Int. Cl.[7] ..... A63C 19/10
(52) U.S. Cl. ..... 472/90; 472/91
(58) Field of Search ..... 472/88, 89, 90, 472/91, 136; 482/71, 146, 147; 434/247, 253

(56) References Cited

U.S. PATENT DOCUMENTS

| | | | | |
|---|---|---|---|---|
| 1,505,914 A | | 8/1924 | Witteborg | |
| 1,782,296 A | | 11/1930 | Goldstein | |
| 2,114,557 A | | 4/1938 | Davis | |
| 2,136,214 A | | 11/1938 | Keith | |
| 2,234,425 A | | 3/1941 | Brady | |
| 2,322,306 A | | 6/1943 | McLaren | |
| 2,609,992 A | | 9/1952 | Matthews | |
| 3,096,718 A | | 7/1963 | Anderson | |
| 3,195,889 A | * | 7/1965 | Hall | 273/DIG. 6 |
| 5,250,530 A | | 5/1966 | Dean et al. | |
| 3,628,789 A | * | 12/1971 | Suroff | 104/58 |
| 3,860,236 A | | 1/1975 | Buchanan | |
| 4,055,112 A | | 10/1977 | Larkfeldt | |
| 4,087,088 A | * | 5/1978 | Kelso | 198/321 |
| 4,148,477 A | * | 4/1979 | Larson | 198/580 |
| 4,345,439 A | | 8/1982 | Gundlach | |
| 4,423,864 A | * | 1/1984 | Wiik | 434/253 |
| 4,790,531 A | * | 12/1988 | Matsui et al. | 238/10 R |
| 4,976,422 A | * | 12/1990 | Shimamura | 472/90 |
| 5,011,152 A | | 4/1991 | Hugunin | |
| 5,031,832 A | | 7/1991 | Ratnick et al. | |
| 5,184,980 A | * | 2/1993 | Ferris | 472/90 |
| 5,230,218 A | | 7/1993 | Clulow | |
| 5,241,830 A | | 9/1993 | Morioka et la. | |
| 5,303,516 A | | 4/1994 | Delamare | |
| 5,327,738 A | * | 7/1994 | Morioka et al. | 472/90 |
| 5,331,991 A | | 7/1994 | Nilsson | |
| 5,482,510 A | | 1/1996 | Ishii et al. | |
| 5,649,865 A | * | 7/1997 | Harvey | 472/90 |
| 5,951,357 A | * | 9/1999 | Mandle et al. | 446/138 |
| 6,079,161 A | | 6/2000 | Tomioka et al. | |

FOREIGN PATENT DOCUMENTS

| | | |
|---|---|---|
| JP | 62-270181 | 11/1987 |
| JP | 5-309158 | 12/1990 |
| JP | 4-135580 | 5/1992 |
| JP | 4-035664 | 6/1992 |
| JP | 6-051122 | 2/1994 |
| JP | 7-23964 | 9/1995 |
| JP | 11-22218 | 7/1997 |
| JP | 10-277199 | 10/1998 |
| JP | 11-319608 | 11/1999 |
| JP | 2996949 | 1/2000 |

* cited by examiner

*Primary Examiner*—Kien T. Nguyen
(74) *Attorney, Agent, or Firm*—Cummings & Lockwood

(57) ABSTRACT

Skiing facilities, which supply artificial snow onto the ski slope floor to form a ski slope, the skiing facilities, comprises a movable ski slope floor provided in a part of the ski slope floor along a width direction, a movable floor driving mechanism, which is provided under the ski slope floor, for driving the movable ski slope floor in up and down directions, a cover member, which is provided under the ski slope floor, for covering a gap generated between the movable ski slope floor and the ski slope floor when the movable slope floor is driven, and a cover member driving mechanism, which is provided under the ski slope floor, for closing a gap generated between the movable ski slope floor and the ski slope floor by driving the cover member.

18 Claims, 10 Drawing Sheets

SKIING FACILITIES CAPABLE OF CHANGING SHAPE OF SURFACE OF SKI SLOPE AND METHOD FOR CHANGING SHAPE OF SURFACE OF SKI SLOPE OF SKIING FACILITIES

BACKGROUND OF THE INVENTION

1. Field of the Invention

The present invention relates to skiing facilities that can provide abundant variations in the shape of the surface of ski slope by mechanically changing a part of the ski slope in various kinds of patterns.

2. Description of the Related Art

In recent years, natural skiing facilities where skiers and snow boarders share use of the ski slope are becoming commonplace. Normally, at natural skiing facilities, the course for a ski run is divided into advanced, intermediate, and elementary courses, and the skiers and snow boarders can ski in accordance with their desirable skill levels. Natural skiing facilities where the ski slope is fully dedicated to use by either snow boarders or skiers have also become common. For example, on a ski slope dedicated to snow boarder use, shapes such as a half pipe, a table top, and the like, which are unique to the snow board, are provided. Also, there is a ski slope designed for exclusive use by skiers and snowboarders that includes use of one or more moguls where a plurality of projections and depressions (bumps) is formed on the ski slope.

However, we have never seen such abundant variations in ski slope topology or configuration at indoor skiing facilities using artificial snow.

Indoor skiing facilities are normally structured in such a manner that an artificial snow layer is formed on a roadbed floored by a copper plate and the like, forming a gentle slope that has no bumps and little variations. For this reason, since the gentle slope at indoor skiing facilities provides little variation and hence, the skiers and snow boarders are merely skiing downhill on the slope, these facilities are found to be lacking in interest and fun.

In order to solve such a problem, we proposed a technique in which the skew angle of the ski slope at the skiing facilities is changeable. For example, Japanese published unexamined patent application Hei 4-135580 shows skiing facilities in which the floor of the ski slope is made movable so that the skew angle of the overall ski slope can be changed.

This structure, however, cannot partially change the skew of the ski slope, with the result that the bumps, the half top, and the like cannot be formed. Accordingly, this method and apparatus fails to provide the ski slope patterns that meet various skill levels of neither skiers nor snowboarders.

Moreover, Japanese published unexamined patent application Sho 52-270181 shows a method for configuring indoor ski slopes wherein artificial turfs are provided on the roadbed and a mat having numerous water boxes on its both front and back faces is provided at a gap between the roadbed and turfs and water injected into the wafer boxes is frozen and expanded, whereby forming bumps on the surface of the ski slope.

This method, however, forms only simple bumps, and there is difficulty in forming a complicated shape such as a half pipe and the like. Since the skew angle of the ski slope itself is unchanged even if the pumps are formed on the surface thereof, the slope for a ski run is still gentle, and hence, unchallenging to skiers or snowboarders of more advanced skill levels. In other words, this method makes it possible to satisfy preferences of some skiers. However, there is difficulty in satisfying preferences of the snowboarders and intermediate and advance level skiers at the same ski slope concurrently.

Still moreover, the another method can be considered wherein the amount of artificial snow is partially changed by a snowmaker to form projections and depressions on the ski slope.

However, according to this method, much time and cost are needed to form a complicated shape using only the snowmaker. Since the skew angle of the ski slope itself cannot be changed similar to the aforementioned method, there is a limitation in variations of the ski slope that can be provided.

None of these cited methods give satisfactory results in developing indoor ski slopes for variable skill levels. They are also inapplicable for use by both skiers and snowboarders.

Thus, it appears that no indoor ski slope methods or assemblies of the prior art can be used for developing ski slopes for use by skiers and snowboarders of a wide variety of skill level.

SUMMARY OF THE INVENTION

The present invention provides assemblies and methods for providing indoor skiing facilities, which may be effectively utilized by both skiers and snowboarders of different skill levels.

One object of the invention is to overcome the lack of efficacy of existing indoor skiing facilities by providing a ski slope with abundant variations by the structure in which a part of a ski slope is formed by a movable floor and the movable floor is moved by a supporting apparatus A more detailed object of this invention is to speedily form a ski slope with abundant variations at low lost by operating the supporting apparatus efficiently.

Another object of the present invention is to satisfy preferences of skiers and snow boarders of various levels by changing the skew angle of a ski slope and varying the ski slope in different patterns.

In order to attain the above object, according to the first aspect of the present invention, there is provided skiing facilities having a ski slope floor and supplying artificial snow onto the ski slope floor to form a ski slope, and the skiing facilities comprises a movable ski slope floor provided in a part of the ski slope floor along a width direction; a movable floor driving mechanism, which is provided under the ski slope floor, for driving the movable ski slope floor in up and down directions; a cover member, which is provided under the ski slope floor, for covering a gap generated between the movable ski slope floor and the ski slope floor when the movable slope floor is driven; and a cover member driving mechanism, which is provided under the ski slope floor, for closing a gap generated between the movable ski slope floor and the ski slope floor by driving the cover member.

According to this structure, it is possible to arbitrarily control the skew angle of only the part of the ski slope in the width direction at the indoor skiing facilities. This makes it possible to form various skew angles with respect to the ski slope of the indoor skiing facilities instead of the gentle slope surface, which is commonly used. For this reason, it is possible to satisfy the preferences of skiers and snow boarders of various levels. Moreover, this can provide the ski slope with various patterns that can respond to various kinds of events and attractions.

According to one embodiment of the present invention, the cover member comprises means for preventing accumulated snow from being slidably dropped on the surface.

This structure prevents accumulated snow that covers the cover member from slidably dropped effectively.

According to another embodiment of the present invention, the movable floor is composed of a plurality of movable members provided to be adjacent to one another. It is preferable that the plurality of movable members should move independently of one another.

This structure makes it possible to easily obtain the ski slope patterns of numerous variations.

According to another embodiment, the ski slope comprises a plurality of movable floors. At least one of the size of movable member, moving direction, and moving range is preferably made different from one another in connection with the plurality of movable floors. This structure makes it possible to form different ski slope patterns concurrently.

According to another embodiment, one end of the movable floor is supported to be slidable to the fixed floor of the ski slope.

This structure allows the movable floor to be smoothly moved.

According to another embodiment, one end of the cover member is fixed to the rear face of the fixed floor of the ski slope to be slidable thereto.

According to this structure, in the case where a caved portion is formed as one of the ski slope patterns, the cover member stored under the fixed floor is advanced with movement of the movable floor, whereby making it possible to cover the gap between the movable floor and the fixed floor.

According to the second aspect of the present invention, there is provided a method for controlling a skew angle of a ski slope at skiing facilities, and the method comprises the steps of: moving a movable floor that constructs a part of the floor of the ski slope with a given stroke; advancing a cover member stored under a fixed floor that constructs a part of the floor of the ski slope toward a gap generated between the movable floor and the fixed floor with advancement of the movable floor; and covering the gap using the cover member.

This method makes it possible to easily change the pattern of the ski slope at the skiing facilities.

These objects, other objects and advantages of the present invention will become readily apparent by the following description and the accompanying drawings.

DETAILED DESCRIPTION OF THE PREFERRED EMBODIMENT

Figure 1:
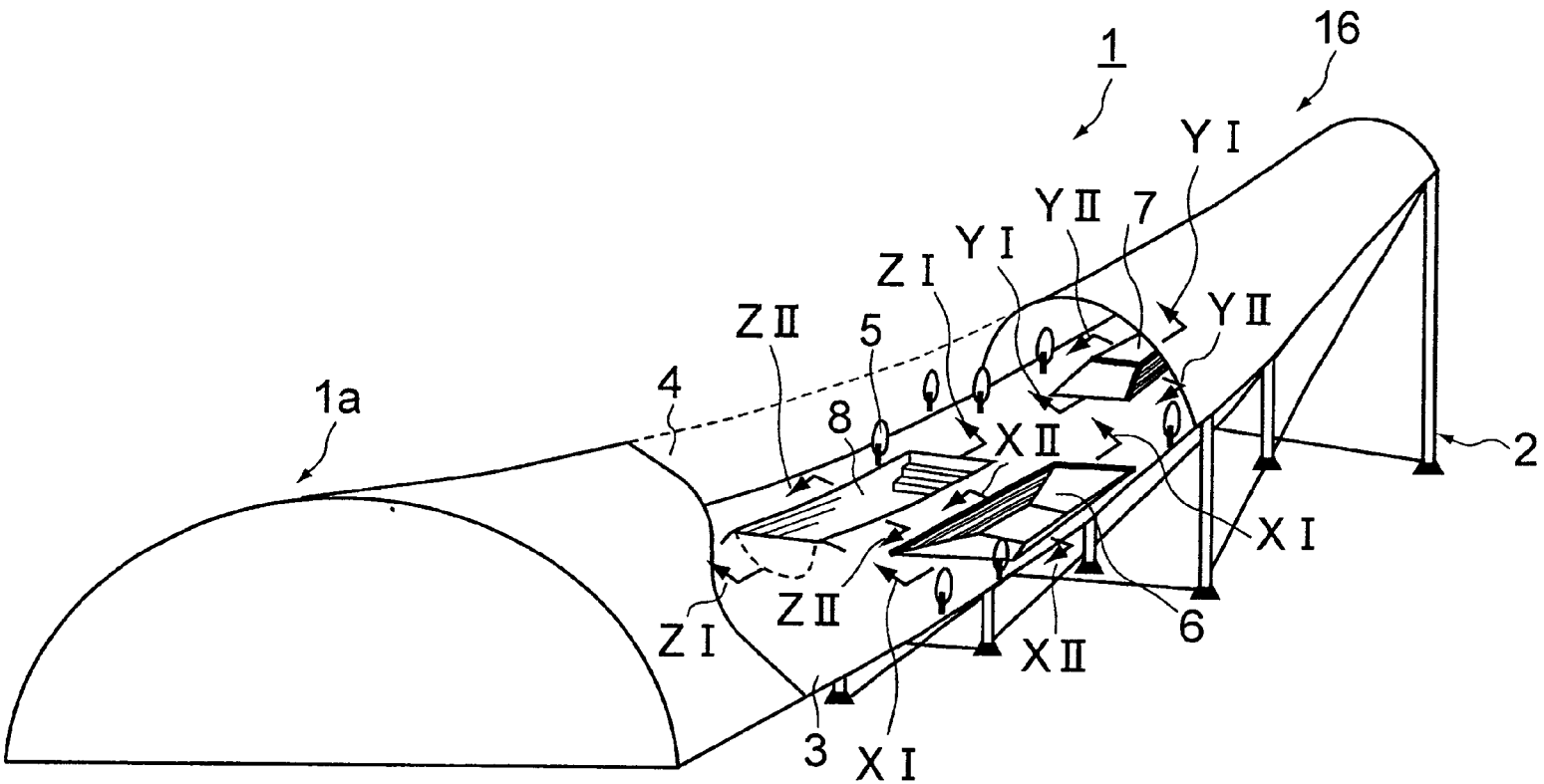
FIG. 1 is a schematic view illustrating the entirety of a ski slope at indoor ski facilities.

The present invention overcomes many of the prior art problems associated with indoor ski slopes. The advantages, and other features of the device and method disclosed herein, will become more readily apparent to those having ordinary skill in the art from the following detailed description of a preferred embodiment taken in conjunction with the drawings which set forth representative embodiments of the present invention and wherein like reference numerals identify similar structural elements. It is noted that the hatching of the cross and the thickness are omitted to avoid complication in cross-sectional views of the drawings attached.

FIG. 1 is a perspective view illustrating an appearance of indoor ski facilities 1 of this embodiment where a part thereof is illustrated in section. The indoor skiing ground 1 is composed of mainly an artificial ski slope 3, which is supported to have a given inclination by a support structural member 2, and a semicircular ceiling section 4, which covers the ski slope 3 to maintain the surroundings thereof in a predetermined atmosphere. In this figure, a left side on the paper indicates a foot side la and a right side on the paper indicates a top side 1*b*, and the ski slope 3 is formed to be gradually wider along a direction from the top 1*b* to the foot 1*a*.

As illustrated in FIG. 1 where the ceiling section 4 is partially cut, snow manufactured by a plurality of snowmakers (not shown) is supplied onto the ski slope 3, and the surface is packed and leveled for skiing downhill. The interior of the skiing facilities 1 is controlled by an air conditioner (not shown) such that temperature and humidity are controlled to be the atmosphere in which snow on the ski slope 3 can be maintained to be a suitable state. It is noted that natural or artificial plants 5 are arranged along both sides at regular intervals. Moreover, numerous snow accumulation detecting sensors (not shown) are provided on the surface of the ski slope 3. The snowmakers are operated automatically or manually in accordance with the accumulation of snow detected by these sensors in order to keep the accumulation of snow uniform.

The ski slope 3 partially includes ski slopes 6 to 8 having a plurality of different patterns, which are the feature of the present invention. More specifically, a caved portion 6, which is formed by changing the skew angle of the part of the ski slope 3 in its width direction, a project portion 7, and a half pipe 8 are created. These ski slope patterns are formed by movable floors and a support apparatus to be described later.

Figure 2:
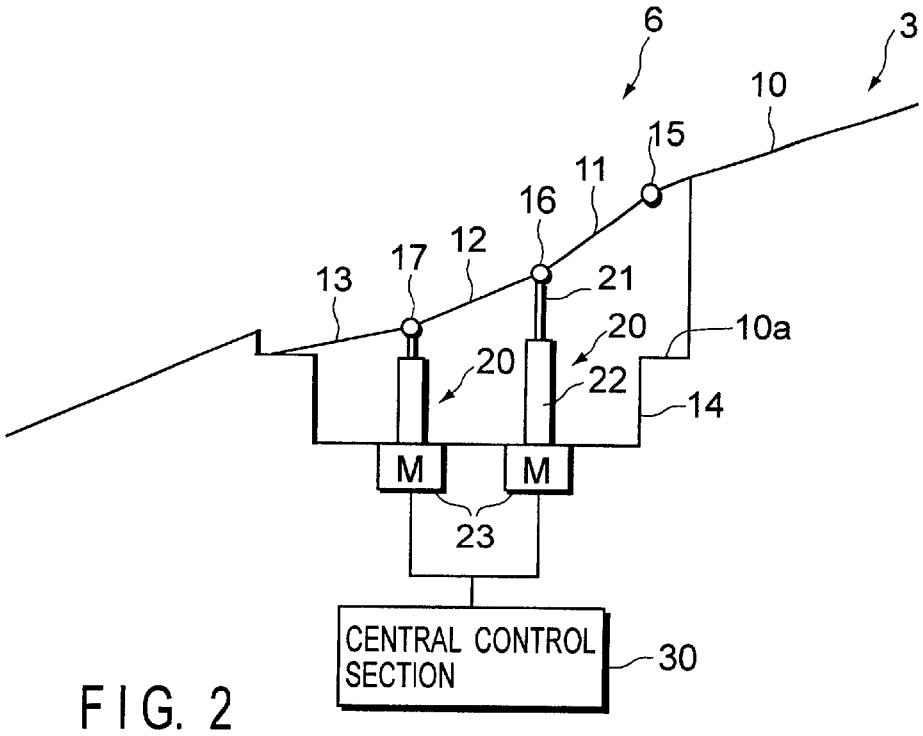
FIG. 2 is a schematic structural view illustrating movable floors provided at a caved portion and main parts of a supporting apparatus.
Figure 3:
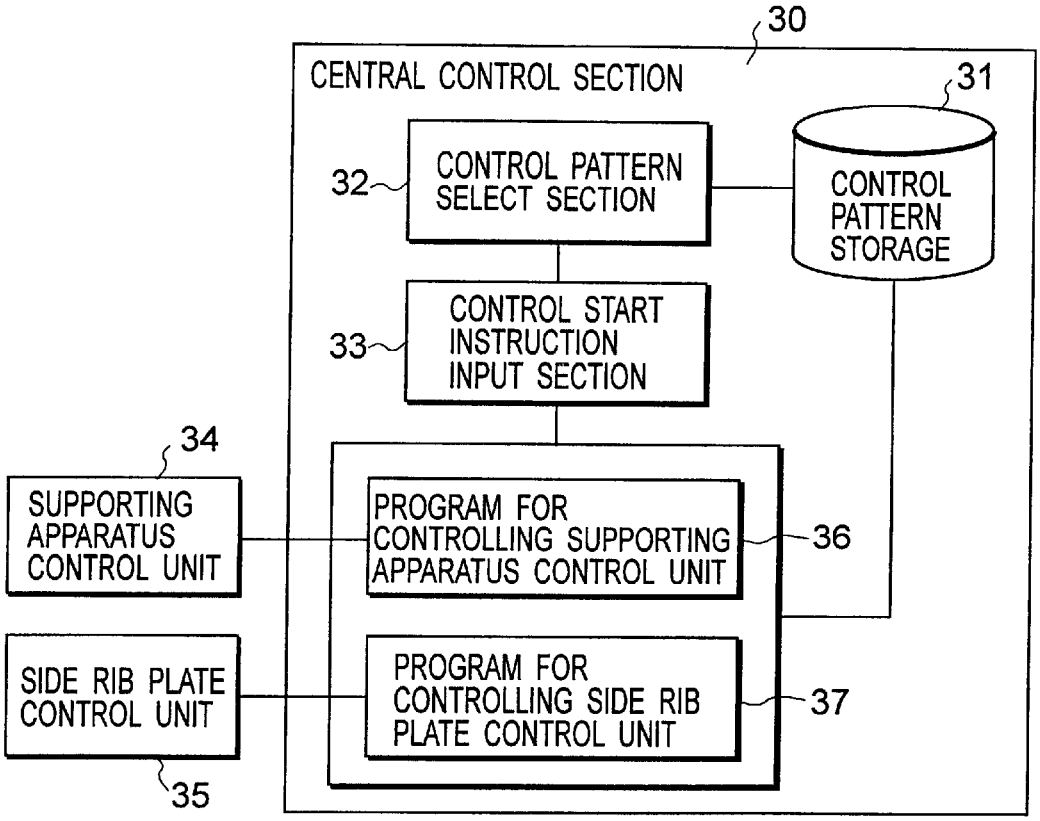
FIG. 3 is a block diagram illustrating the structure of a central control section.

FIG. 2 is a vertical cross-sectional view taken on line XI—XI of FIG. 1 to illustrate the schematic structure of the caved portion 6 among the plurality of ski slope patterns. In the figure, the right side on the paper indicates an upper slope.

The ski slope 3 is composed of a fixed floor 10, which is fixed at a predetermined angle, and a plurality of movable floors 11 to 13, which elevate up and down by a supporting apparatus 20 to change the skew angle. Under the movable floors 11 to 13, there is formed a part of the fixed floor 10 that is hollowed to form a storage space 14 for the supporting apparatus 20. Heat insulating materials, snow accumulation detecting sensors, projections for preventing accumulated snow from being slidably dropped and the like are appropriately formed on the surface of the fixed floor 10 and the surfaces of the movable floors 11 to 13. Moreover, a drainage channel for snow melting water is provided at the lower portion of the ski slope 3 or the side portion thereof. Since these structures are known, the illustration and explanation are omitted.

The caved portion 6 is structured by connecting three plate-like movable floors 11, 12, and 13 to one another. The first movable floor 11 located at the top side is structured in such a way that the upper end is rotatably fixed to the fixed floor 10 by a hinge 15. The lower end of the fist movable floor 11 is rotatably fixed to the upper end of the second movable floor 12 located at the center by a hinge 16. Similarly, the lower end of the second movable floor 12 is rotatably fixed to the upper end of the third movable floor 13 located at the foot side by a hinge 17.

The lower end of the third movable floor 13 abuts against the fixed floor 10 of the ski slope 3 to be slidable back and forth (right and left on paper), so that it can keep up with the change in the skew angle. This makes it possible for the movable floors 11, 12, and 13 to move using the hinges 15, 16, and 17 as fulcrums, with the result that the skew angle of the ski slope 3 can be changed.

An explanation will be next given of the support apparatus 20.

The supporting apparatus 20 is composed of an extendable member 21 and storage enclosure 22. The extendable member 21 is connected to the hinges 16 and 17, which are connecting section of the movable floors 11 to 13. The storage enclosure 22 is adhered to the support floor 10*a* and stores the extendable member 21. The extendable member 21 is structured as a rack having numerous teeth on its side surface, and these numerous teeth are meshed with a pinion (not shown) provided in the storage enclosure 22. Then, the pinion is rotatably driven by a drive source 23 such as a synchronous motor and the like, with the result that the extendable member 21 expands and contracts up and down with respect to the storage enclosure 22. The way of expanding and contracting the extendable member 21 is not limited to the aforementioned method, and a hydraulic jack, for example, may be used.

The extendable member 21 is intensively controlled by a central control section 30. The central control section 30 comprises control pattern storage 31 for storing control patterns of the extendable member 21 of the supporting apparatus 20 and those of a slide member 25 of a side rib plate 24 to be described later. With regard to the supporting apparatus 20 and the side rib plate 24, the respective control patterns define operation timing from the start time, positions of the movable floors 11 to 13, and the position of the side rib plate 24, and they are prepared in accordance with the ski slope patterns that are formable in the corresponding ski ground.

The central control section 30 further comprises a control pattern select section 32 for selecting one pattern from the control storage 31 and a control start instruction input section 33 for starting control in response to the selected control pattern. The control pattern select section 32 further comprises a program 36 for controlling the supporting apparatus 20 in response to the selected control pattern and a program 37 for controlling the side rib plate 24.

The respective structural components of the central control section 30 are actually a computer software program stored in a given storage area, which is reserved in a hard disk of the computer system and ROM, and a part of the storage area. The computer software program is appropriately called up on RAM and executed by a CPU (not shown), whereby exerting the function of this embodiment.

Figure 4:
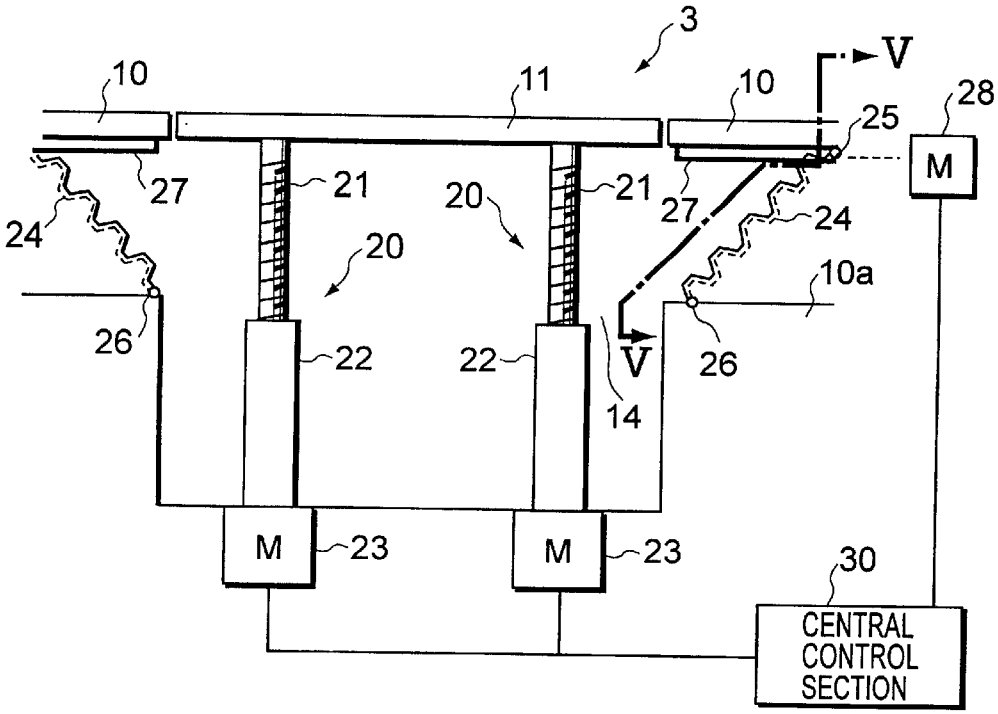
FIG. 4 is a schematic structural view of the caved portion illustrating a state in which the movable floors are not moved yet.
Figure 5:
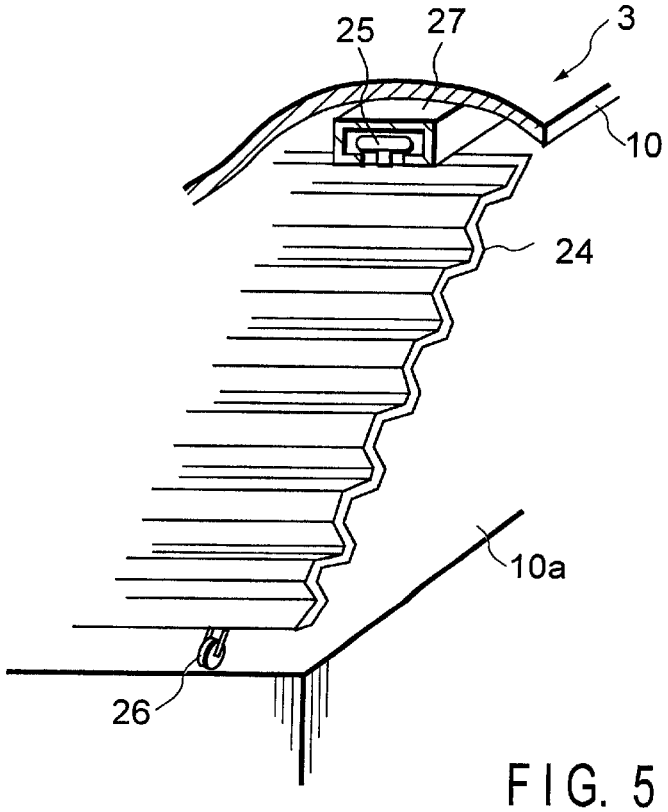
FIG. 5 is a perspective view illustrating a state in which a side rib plates are attached.

An explanation will be next given of the process of forming the caved portion 6 in the part of the ski slope 3 and the schematic structure of the caved portion 6 with reference to FIGS. 4 to 8. In these figures, views other than FIG. 5 are cross-sectional views taken on line XII—XII of FIG. 1, and a front side on the paper indicates a top side and an inner side on the paper indicates a foot side. Among the plurality of movable floors 11 to 13, only the central movable floor 12 is illustrated for the sake of expediency.

FIG. 4 is a transverse cross-sectional view of the main parts illustrating the flat ski slope before the movable floor 12 is operated. In the state of this figure, the extendable member 21 of the supporting apparatus 20 is placed at the uppermost position.

In the right and left storage spaces 14, 14 formed under the fixed floor 10, side rib plates 24, 24 are stored respectively. Each side rib plate 24 functions as a cover member that covers the gap generated between the movable floor 12 and the fixed floor 10 when the movable floor 12 moves down. The side rib plates 24, 24 are intended to structure the part of the ski slope 3, and are made of copperplates and the like having strength equivalent to that of the fixed floor 10 and that of the movable floor 12. The entirety of each side rib plate 24 is formed to have projections and depressions in order to prevent accumulated snow from being slidably dropped. At the upper end portion of each side rib plate 24, there is provided T-shaped slide member 25, which is integral with the side rib plate 24 and which is engaged with a guide rail 27 formed at the rear face of the fixed floor 10.

At the lower end portion thereof, there is provided a caster 26. The slide member 25 is connected to a drive source 28 such as a motor in such a way that it can move back and forth to the movable floor 12. With this structure, when the slide member 25 moves back and forth to the movable floor 12, the caster 26 provided at the lower end portion of the side rib plate 24 rotates on the fixed floor 10 in the storage space 14. As a result, the entirety of the side rib plate 24 moves back and forth to the fixed floor 10. The drive source 28 is intensively controlled by the central control section 30 similar to the drive source 23 for the supporting apparatus 20.

Figure 6:
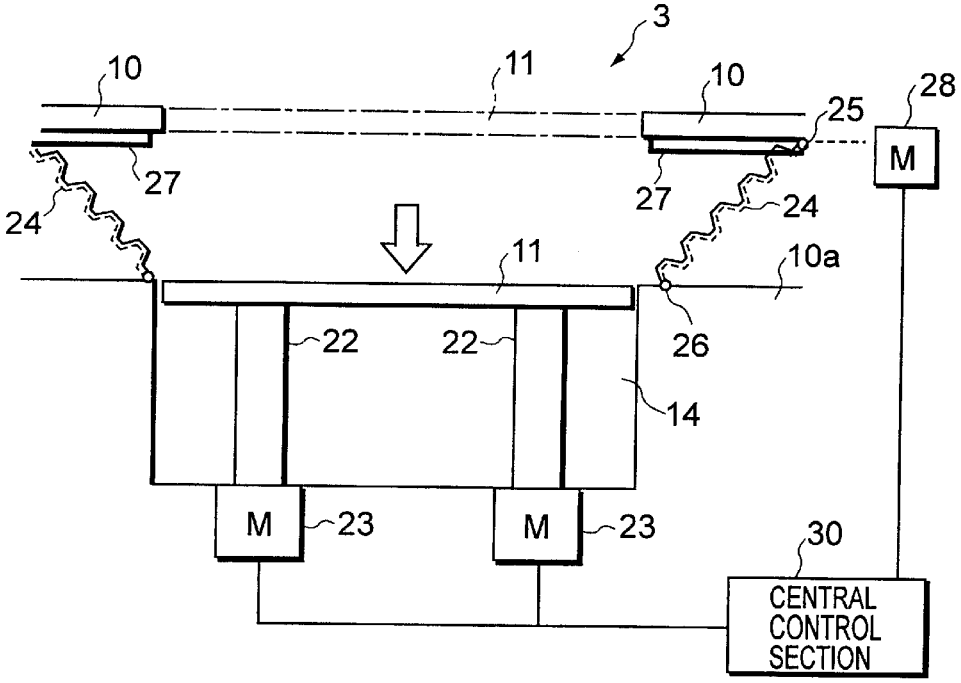
FIG. 6 is a schematic structural view of the caved portion illustrating a state in which the movable plate is moved to the lowest position.
Figure 7:
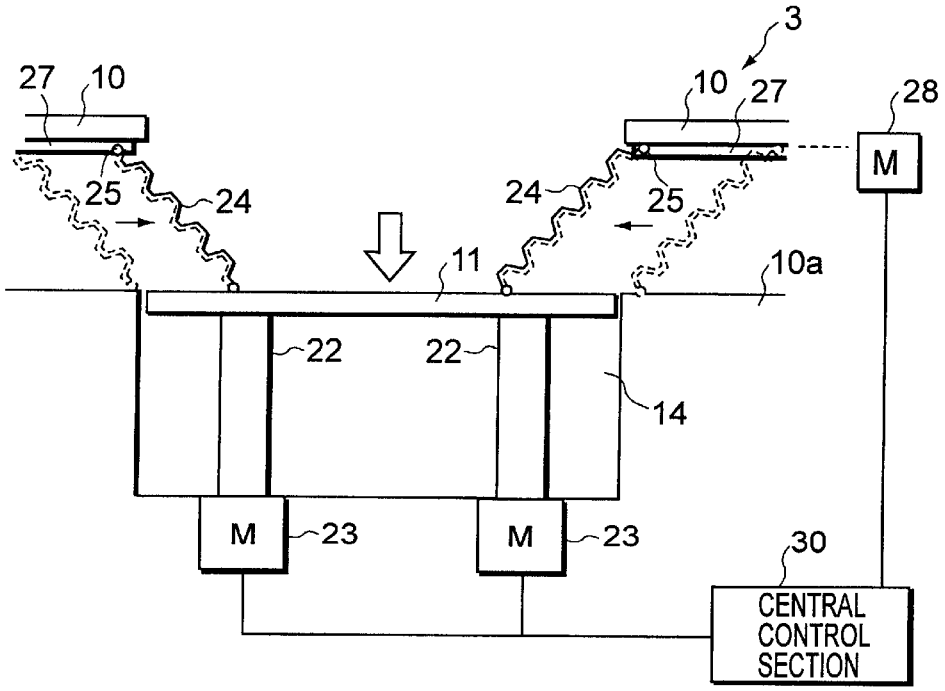
FIG. 7 is a schematic structural view of the caved portion illustrating a state in which the side rib plates advance.

In FIG. 4, when the manager of the skiing facilities outputs an instruction to form the caved portion 6 from the input apparatus, the state as illustrated in FIG. 6 can be obtained. In this figure, the drive source 23 for the supporting apparatus 20 is driven, so that the extendable member 21 is stored in the storage enclosure 22 and the movable floor 12 is moved from the uppermost position indicated by chain lines to the lowermost position indicated by solid lines. In this state, the movable floor 12 is flush with a support floor 10*a* provided in the storage space 14.

Then, when the fact that the movable floor 12 reaches the lowest position is detected by the sensor and the like, an instruction to drive is outputted to the drive source 28 for side rib plates 24, 24, with the result that the right and left side rib plates 24, 24 are slid to the movable floor 12. At this time, the positions of right and left side rib plates 24, 24 can be made different from each other right and left.

Figure 8:
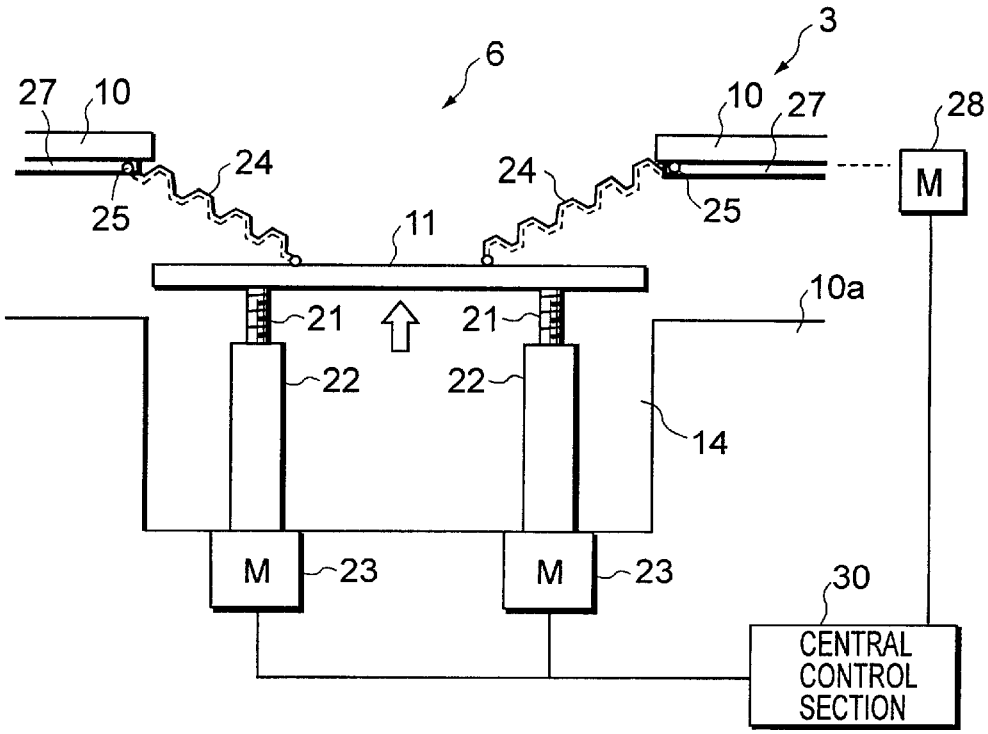
FIG. 8 is a schematic structural view of the caved portion that is completed.

After that, when the advancing operations of the side rib plates 24, 24 are completed, the movable floor 12 side-rises as illustrated in FIG. 8. As a result, the upper and lower positions of the movable floor 12, namely the depth of the caved portion 6 can be finely adjusted as required.

The caved portion 6 can be easily formed in the part of the ski slope 3 by the aforementioned process.

An explanation will be next given of the schematic structure of a project portion 7 with reference to FIGS. 9 to 12. In these figures, it is noted that the same reference numerals as those of the aforementioned caved portion 6 are added to the parts corresponding to those of the caved portion 6, and the explanation is omitted.

Figure 9:
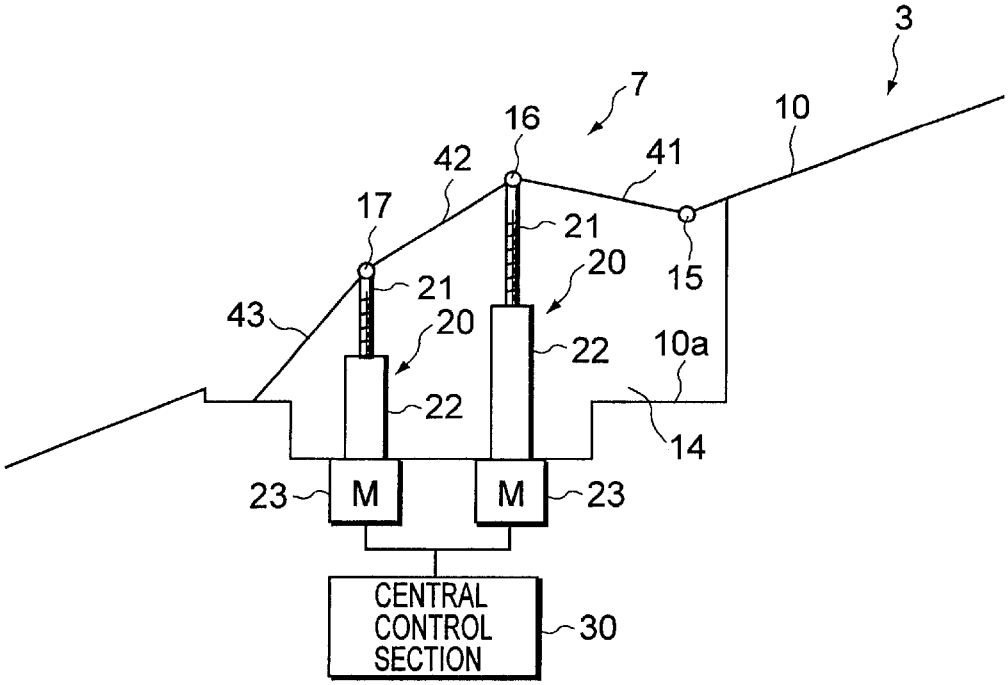
FIG. 9 is a schematic structural view illustrating the movable floors of a project portion and the main parts of the supporting apparatus.

FIG. 9 is a vertical cross-sectional view taken on line of YI—YI of FIG. 1 to illustrate the project portion 7. In this figure, the right side on the paper indicates an upper slope. The project portion 7 is also structured in such a way that the skew angle of the ski slope 3 is changed by three movable floors 41 to 43 and the supporting apparatus 20.

Figure 10:
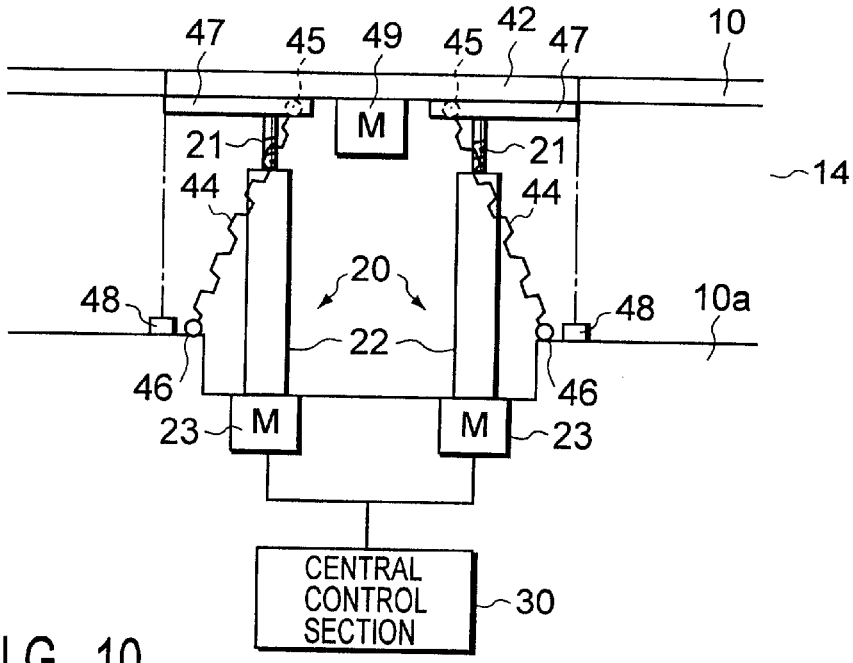
FIG. 10 is a schematic structural view of the project portion illustrating a state in which the movable floors are not moved yet.
Figure 11:
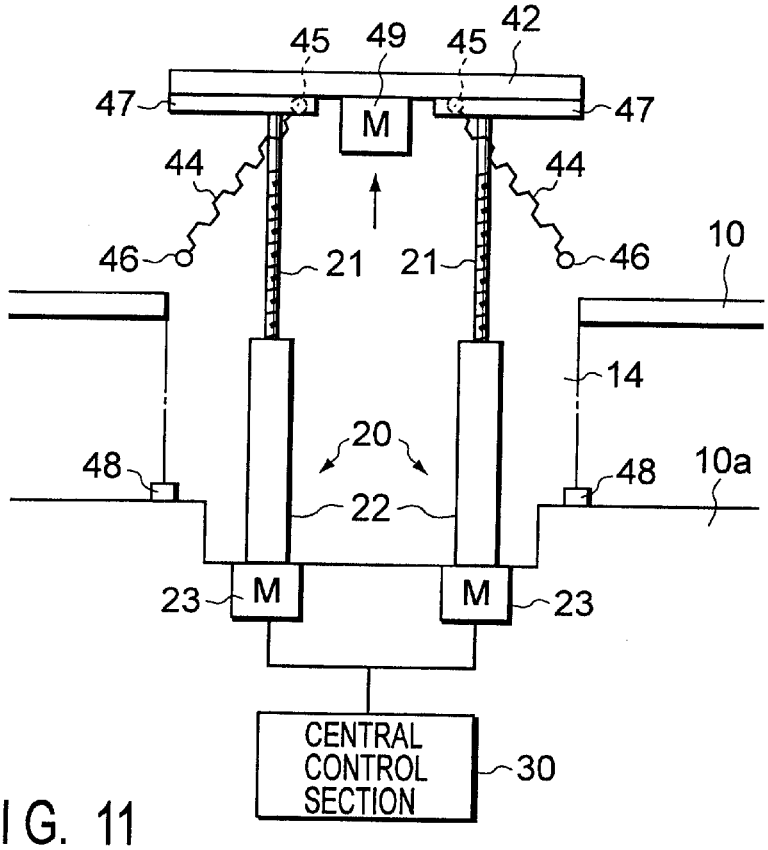
FIG. 11 is a schematic structural view of the project portion illustrating a state in which the movable plates are moved to the lowest position.
Figure 12:
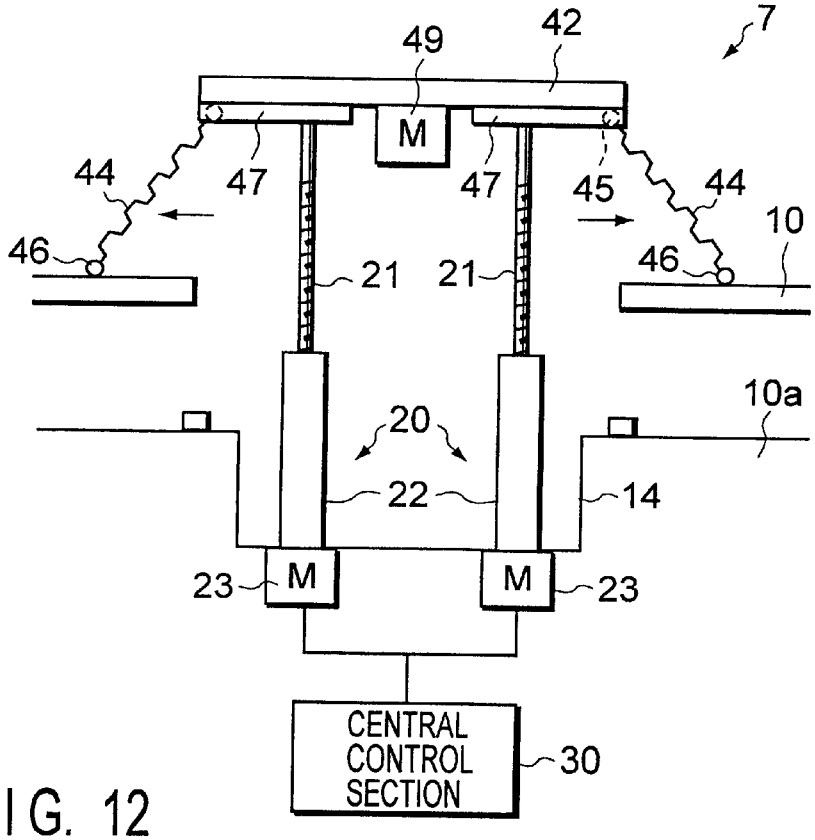
FIG. 12 is a schematic structural view of the project portion illustrating a state in which the side rib plates advance.

FIGS. 10 to 12 are transverse cross-sectional views taken on line YII—YII of FIG. 1 and each illustrates the process of forming the project portion 7. In these figures, only a central movable floor 42 is illustrated among three movable floors 41 to 43.

FIG. 10 illustrates the state in which the movable floor 42 is not moved up yet. In this embodiment, a guide rail 47, with which a slide member 45 is engaged, is fixed to the rear face of the fixed floor 42. Then, in the state of FIG. 10, the slide member 45 is placed at the position closest to the center of the movable floor 42. A drive source 49 such as a motor for sliding the slide member 45 is attached to the rear face of the movable floor 42. Moreover, a caster 46 provided at the lower end portion of a side rib plate 44 abuts against the support floor 10*a*. Also, the caster 46 is restrained from moving out of the side end portion (indicated by chain lines in the figure) of the movable floor 42 by a stopper 48, which is provided at the support floor 10*a* in an extended condition.

When the manager of the skiing facilities outputs an instruction to form the project portion 7, the extendable member 21 rises and pushes up the movable floor 42 by the drive source 23 as illustrated in FIG. 11. Then, the side rib plate 44, which has an upper end engaged and fixed to the rear face of the movable floor 42, also rises concurrently. At this time, the lower end portion of the side rib plate 44 is positioned inwardly than the side end portion of the movable floor 42 by the stopper 48. For this reason, at the rising time, the lower end portion thereof does not interfere with the end portion of the fixed floor 10.

When the sensor and the like detect that the lower end portion (caster 46) of the side rib plate 44 rises and reaches upwardly than the fixed floor 10, the drive source 49 drives to slide the slide member 45 and move the side rib plate 44 in the direction of the fixed floor 10 as illustrated in FIG. 12.

Figure 13:
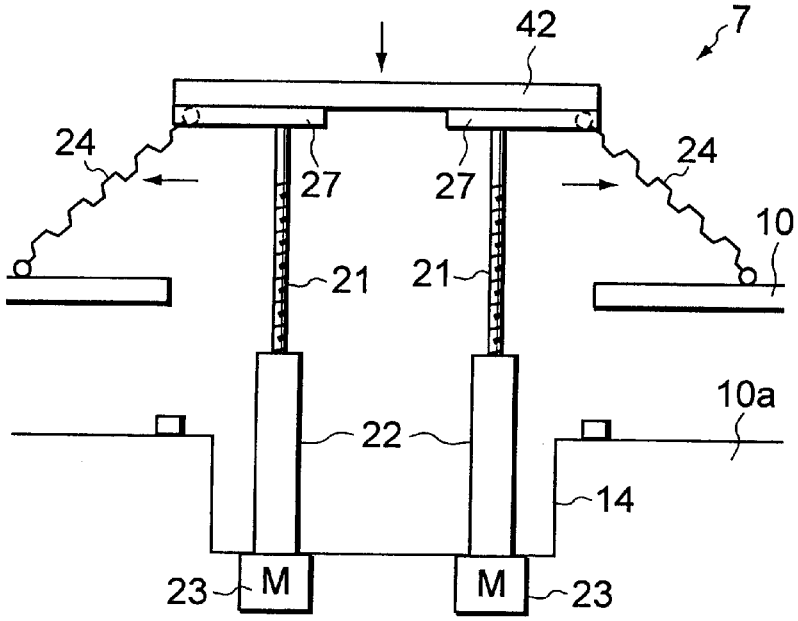
FIG. 13 is a schematic structural view of the project portion that is completed.

Finally, the movable floor 42 moves down as required to finely adjust the height of the project portion 7, with the result that the completed state can be obtained as illustrated in FIG. 13.

The project portion 7 can be easily formed in the part of the ski slope 3 by the aforementioned structure and process.

An explanation will be next given of the structure of the half pipe 8 and the forming process thereof with reference to FIGS. 14 to 18. In these figures, it is noted that the same reference numerals as those of the aforementioned caved portion 6 and project portion 7 are added to the parts corresponding thereto, and the explanation is omitted.

Figure 14:
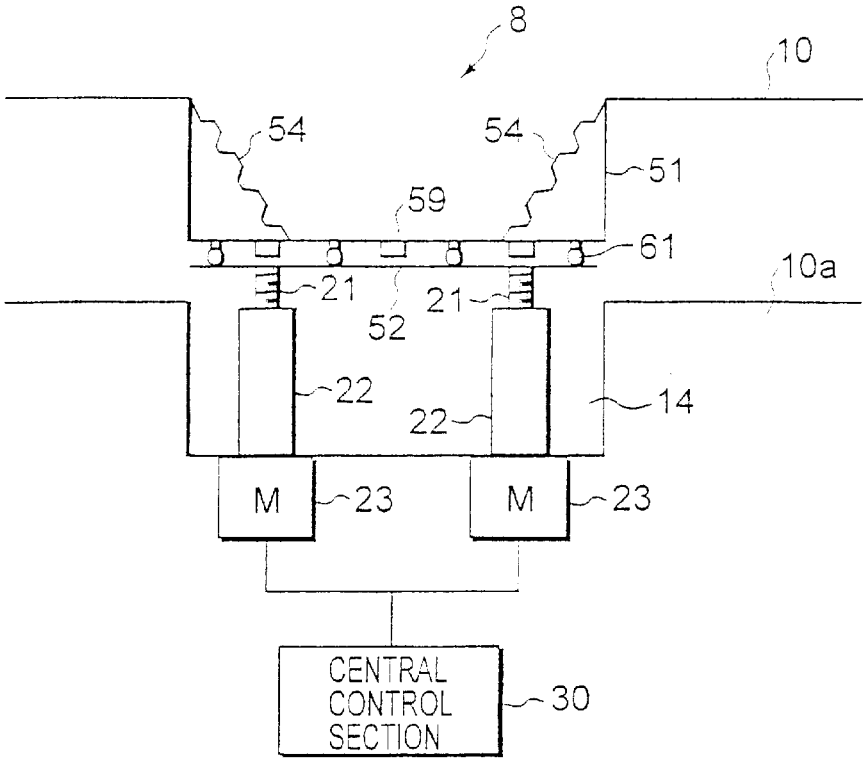
FIG. 14 is a schematic structural view illustrating the movable floors of a half pipe and the main parts of the supporting apparatus.

FIG. 14 is a vertical cross-sectional view taken of line ZI—ZI of FIG. 1 to illustrate the main parts of the half pipe 8, and the right side on the paper indicates the upper slope. In this figure, a curved floor 51 forms a ski run surface of the half pipe 8. A cover member 54 for covering the gap between the curved floor 51 and the fixed floor 10 is fixed to the front and back (right and left on the paper) end portions of the curved floor 51. It is preferable that the cover member 54 should be semiconically formed. Namely, the cover member 54 is formed such a way that its lower surface is fit to the curved floor 51 and smoothly comes in contact with the curved floor 51. This shape makes it possible to generate the ski run surface, which is continuous even at the front and back end portions of the curved floor 51.

An explanation will be next given of the process of forming the half pipe 8 in the part of the ski slope 3 with reference to FIGS. 15 to 18. These figures are transverse cross-sectional views taken on line of ZII—ZII of FIG. 1, and the inner side on the paper indicates the foot side.

Figure 15:
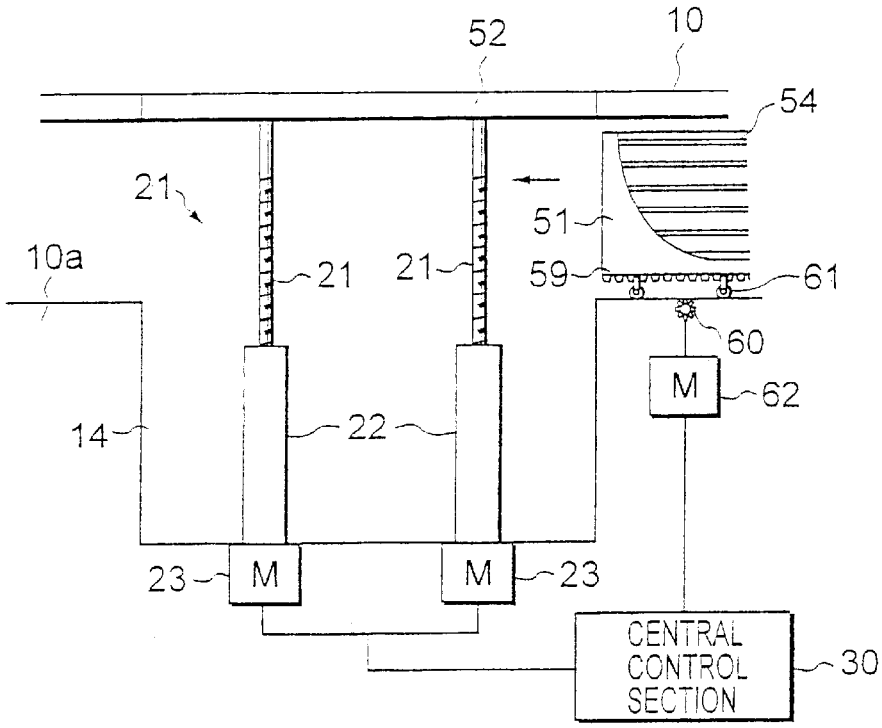
FIG. 15 is a schematic structural view of the half pipe illustrating a state in which the movable floors are not moved yet.

FIG. 15 is a state in which a movable floor 52 is not moved yet. In this state, the curved floor 51 and the cover member 54 are stored in the storage space 14 formed between the fixed floor 10 and the support floor 10*a*. The curved floor 51 has a plurality of casters 61, 61 on the lower surface, and these casters are structured in such a way as to be movable to the direction of the movable floor 52 (supporting apparatus 20). On the lower surface of the curved floor 51, there is provided a plurality of rack rails 59 having numerous teeth in the direction (inner side on the paper) perpendicular to the advancing direction indicated by an arrow in FIG. 15. The numerous teeth of the rack rail 59 are engaged with a gear 60 provided at the upper surface side of the support floor 10*a* to make it possible to move the curved floor 51. The lower end of the rack rail 59 is positioned upwardly than the lower end (setting surface) of the casters 61. Namely, at the time of moving the curved floor 51, only the casters 61 contact the support floor 10*a* and the movable floor 52. As a result, even if the formation of the half pipe 8 and the return to the flat ski slope 3 are repeated, the support floor 10*a* and the movable floor 52 are neither deteriorated nor broken by friction generated between the rack rail 59 and the support floor 10*a* or the movable floor 52.

The gear 60 is rotatably driven by a drive source 62 such as a motor. The gear 60 is normally stored in the support floor 10*a*. The gear 60 is preferably structured in such a way as to rise to the upper surface of the support floor 10*a* when an instruction to move the curved floor 51 is outputted. The rise of the gear 60, and the rotation thereof, are also controlled by the central control section 30.

The cover member 54 is provided at the front and back end portions of the curved floor 51. The cover member 54 may be moved in a different process in synchronization with movement of the movable floor 52 similar to the aforementioned processes of the caved portion 6 and the project portion 7. This makes it possible to move only the cover member 54 to be subjected to fine adjustments after moving the curved floor 51. Or, this makes it possible to change the width of the half pipe 8 (length in the back and forth directions).

Figure 16:
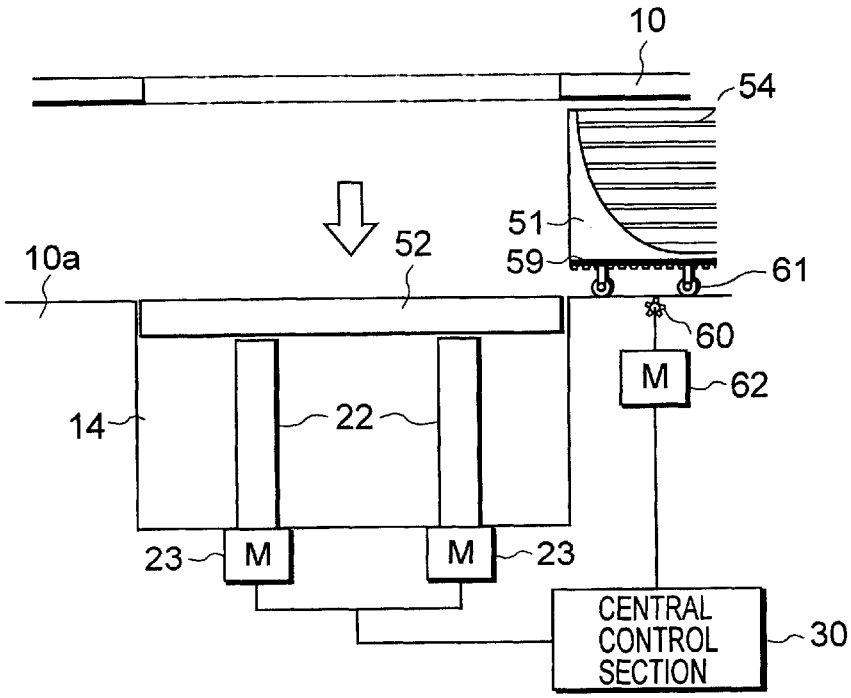
FIG. 16 is a schematic structural view of the half pipe illustrating a state in which the movable plates are moved to the lowest position.

When the manager of the skiing facilities outputs an instruction to form the half pipe 8 from the input apparatus in the state of FIG. 15, the extendable member 21 contracts and the movable floor 52 moves down as illustrated in FIG. 16. At this time, the upper surface of the movable floor 52 and that of the support floor 10*a* are flush with each other.

Figure 17:
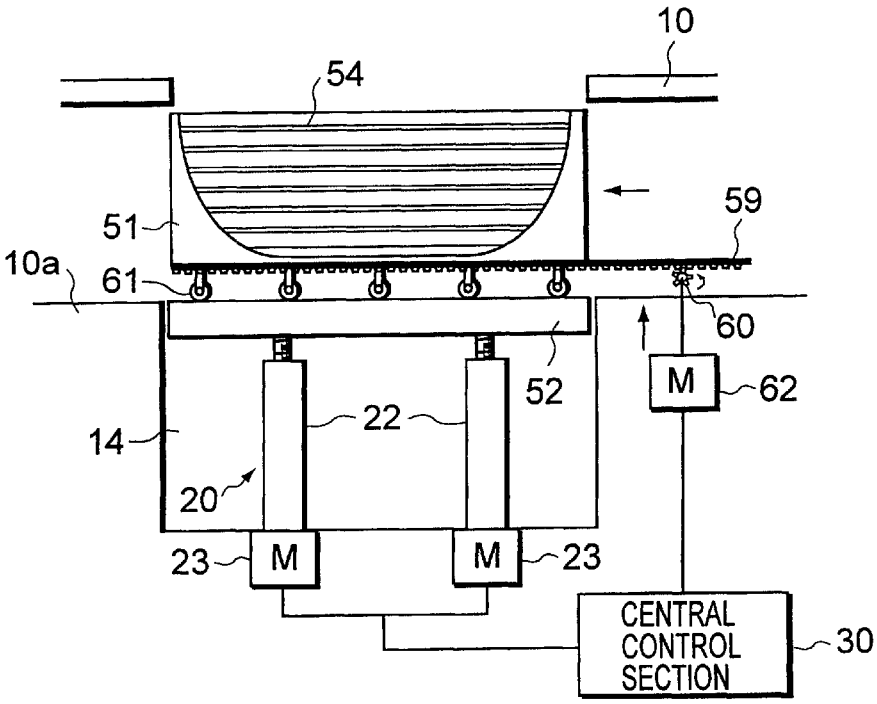
FIG. 17 is a schematic structural view of the half pipe illustrating a state in which a curved floor is mounted on the movable floor.
Figure 18:
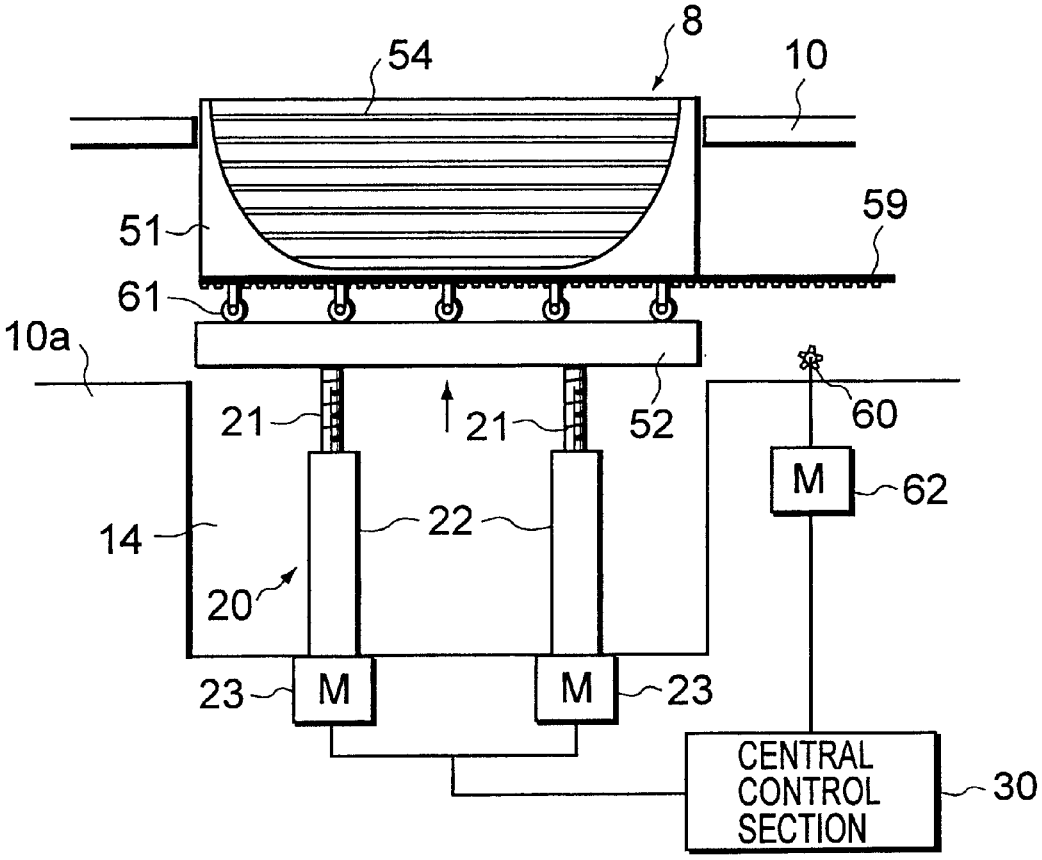
FIG. 18 is a schematic structural view illustrating a state in which the movable floor and curved floor rise and the half pipe is completed.

When the fact that the movable floor 52 reaches the lowest position is detected by the position sensor and the like, the gear 60 rises to the portion close to the upper surface of the support floor 10*a*. Sequentially, the rotatable drive is started after the gear 60 is engaged with the numerous teeth of the rack rail 59. Whereby, the curved floor 51 slides to the movable floor 52. When the entirety of the curved floor 51 moves onto the movable floor 52 as illustrated in FIG. 17, the rotation of the gear 60 is stopped.

After that, the extendable member 21 starts to rise again, such that the movable floor 52 on which the curved floor 51 is mounted is moved upward. Then, when the upper end of the curved floor 51 moves to the upper portion than the fixed floor 10, the rise of the extendable member 21 is stopped. This completes the formation of the half pipe 8.

The reason why the upper end of the curved floor 51 is positioned upwardly than the fixed floor 10 is as follows:

In the case where the half pipe 8 is formed in the part of the ski slope 3 in the width direction, the other parts are used by general skiers. For this reason, if the upper end of the curved floor 51 is flush with the fixed floor 10 or it is lower than the fixed floor 10 such that the entirety of the half pipe 8 is lower than the fixed floor 10, there is a possibility that the skier will accidentally drop in the half pipe 8 or bump into the snow boarder, who uses the half pipe 8. Accordingly, it is preferable that a partition should be provided between the half pipe 8 and the other parts by use of the outer wall of the curved floor 51. In actuality, since artificial snow is accumulated around the outer wall, such danger that the skier bumps into the snow boarder does not occur.

The present invention is not limited to the above-mentioned embodiment, and various changes and modifications may be made in the invention without departing from the spirit and scope thereof.

For example, it is possible to form a quarter pipe for a snowboard and an attraction such as a lobster by applying the structures of the project portion 7 and half pipe 8.

Additional advantages and modifications will readily occur to those skilled in the art. Therefore, the invention in its broader aspects is not limited to the specific details and representative embodiments shown and described herein. Accordingly, various modifications may be made without departing from the spirit and scope of the general inventive concept as defined by the appended claims and their equivalents.

What is claimed is:

1. Skiing facilities having a ski slope floor and supplying artificial snow onto the ski slope floor to form a ski slope, said skiing facilities comprising:

a movable ski slope floor provided in a part of said ski slope floor along a width direction;

a movable floor driving mechanism, which is provided under said ski slope floor, for driving said movable ski slope floor in up and down directions;

a cover member, which is provided under said ski slope floor, for covering a gap generated between said movable ski slope floor and said ski slope floor when said movable slope floor is driven; and a cover member driving mechanism, which is provided under said ski slope floor, for closing a gap generated between said movable ski slope floor and said ski slope floor by driving said cover member.

2. The skiing facilities according to claim 1, wherein the surface of said cover member is formed to have a shape that can prevent artificial snow from being slidably dropped.

3. The skiing facilities according to claim 1, wherein the surface of said cover member is structured to have a curved surface such that a half pipe can be formed.

4. The skiing facilities according to claim 3, wherein the respective movable ski slope floors provided at the plurality of arbitrary locations are different from one another in their sizes and driving patterns.

5. The skiing facilities according to claim 4, further comprising a control unit, which is connected to said movable floor driving mechanism and cover member driving mechanism, for selectively moving the respective movable ski slope floors provided at the plurality of arbitrary locations.

6. The skiing facilities according to claim 1, wherein said movable ski slope floor is provided at a plurality of arbitrary locations of said ski slope.

7. The skiing facilities according to claim 1, wherein said movable ski slope floor is composed of a plurality of plate members, which are connected to one another such that relative skew angles can be made different from one another, and said movable floor driving mechanism drives said movable ski slope floor in up and down directions such that the relative skew angles among said plate members can be arbitrarily set.

8. A method for controlling a skew angle of a ski slope at skiing facilities wherein said skiing facilities have a ski slope floor for holding artificial snow, said ski slope floor has a movable ski slope floor in a part along a width direction, and a cover member is provided under said ski slope floor to cover a gap generated between said movable ski slope floor and said ski slope floor when said movable slope floor is driven, said method comprising the steps of:

(a) driving said movable ski slope floor to said ski slope floor in up and down directions;

(b) covering the gap generated between said movable ski slope floor and said ski slope floor using said cover member; and (c) supplying artificial snow onto the surfaces of said ski slope floor, said movable ski slope, and said cover member.

9. A method as recited in claim 8, further comprising the step of inserting a caved portion into the ski slope.

10. A method as recited in claim 8, further comprising the step of inserting an upwardly projecting portion relative to the ski slope.

11. A method as recited in claim 8, further comprising the step of inserting a half pipe into the ski slope.

12. A skiing facility comprising:

a ski slope upon which is disposed a quantity of snow to form a ski slope, the ski slope defining a length and width;

a moveable ski slope floor interposed as a part of said ski slope;

a driving mechanism for supporting and driving the moveable ski slope floor in an axis substantially perpendicular to the width and length;

a cover member coupled to the ski slope for covering a gap defined by the moveable ski slope floor and the ski slope when said moveable ski slope floor is driven; and a cover member driving mechanism coupled to the cover member for closing the gap generated between the moveable ski slope floor and the ski slope floor by driving the cover member.

13. A skiing facility as recited in claim 12, wherein the surface of the cover member is formed to have a shape that can prevent snow from being slidably dropped.

14. A skiing facility as recited in claim 12, wherein the surface of the cover member is structured to have a curved surface such that a half pipe can be formed.

15. A skiing facility as recited in claim 12, further comprising a plurality of moveable ski slope floors interposed at arbitrary locations of the ski slope.

16. A skiing facility as recited in claim 15, wherein the plurality of moveable ski slope floors are different from one another in their sizes and driving patterns.

17. A skiing facility as recited in claim 16, further comprising a control unit connected to each of the moveable ski slope floor driving mechanisms and cover member driving mechanisms of the plurality of moveable ski slope floors and the respective cover members, for selectively moving respective moveable ski slope floors provided at the plurality of arbitrary locations.

18. A skiing facility as recited in claim 12, wherein the moveable ski slope floor is composed of a plurality of plate members, each plate member being connected such that relative skew angles can be made different from one another, and said moveable floor driving mechanism drives said moveable ski slope floor in an axis substantially perpendicular to the width and length such that the relative skew angles among said plate members can be arbitrary set.

* * * * *

UNITED STATES PATENT AND TRADEMARK OFFICE

CERTIFICATE OF CORRECTION

PATENT NO. : 6,508,717 B2
DATED : January 21, 2003
INVENTOR(S) : Katayama

It is certified that error appears in the above-identified patent and that said Letters Patent is hereby corrected as shown below:

Column 12,
Line 17, claim 18 should read as follows:

18. A skiing facility as recited in Claim 12, wherein the movable ski slope floor is composed of a plurality of plate members, each plate member being connected such that relative skew angles can be made different from one another, and said movable floor driving mechanism drives said movable ski slope floor in an axis substantially perpendicular to the width and length such that the relative skew angles among said plate members can be arbitrarily set.

Signed and Sealed this

Tenth Day of June, 2003

JAMES E. ROGAN
*Director of the United States Patent and Trademark Office*